US010505262B2

(12) United States Patent
Liu et al.

(10) Patent No.: US 10,505,262 B2
(45) Date of Patent: Dec. 10, 2019

(54) ANTENNA STRUCTURE AND WIRELESS COMMUNICATION DEVICE USING SAME

(71) Applicant: Chiun Mai Communication Systems, Inc., New Taipei (TW)

(72) Inventors: Chien-Chang Liu, New Taipei (TW); Ting-Chih Tseng, New Taipei (TW); Kun-Lin Sung, New Taipei (TW); Hsi-Chieh Chen, New Taipei (TW); Peng-Yu Lai, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 15/835,401

(22) Filed: Dec. 7, 2017

(65) Prior Publication Data

US 2018/0183139 A1 Jun. 28, 2018

(30) Foreign Application Priority Data

Dec. 23, 2016 (CN) ..... 2016 1 1206378

(51) Int. Cl.
*H01Q 1/48* (2006.01)
*H01Q 1/24* (2006.01)
*H01Q 5/35* (2015.01)

(52) U.S. Cl.
CPC ..... *H01Q 1/243* (2013.01); *H01Q 1/48* (2013.01); *H01Q 5/35* (2015.01)

(58) Field of Classification Search
CPC ..... H01Q 1/243; H01Q 5/35; H01Q 5/731
USPC ..... 343/845, 700 MS
See application file for complete search history.

(56) References Cited

U.S. PATENT DOCUMENTS

| | | | | |
|---|---|---|---|---|
| 9,337,547 | B2 * | 5/2016 | Kim | H01Q 21/0075 |
| 9,520,646 | B1 * | 12/2016 | Nair | H01Q 1/48 |
| 10,008,782 | B2 * | 6/2018 | Watson | H01Q 1/525 |
| 2008/0129632 | A1 * | 6/2008 | Moon | H01Q 1/243 343/848 |
| 2010/0026585 | A1 | 2/2010 | Pan | |
| 2010/0177005 | A1 * | 7/2010 | Hsiao | H01Q 1/243 343/845 |
| 2011/0215971 | A1 * | 9/2011 | Rao | H01Q 1/243 343/702 |
| 2012/0194390 | A1 | 8/2012 | Endo et al. | |
| 2015/0200457 | A1 * | 7/2015 | Chan | H01Q 9/40 343/700 MS |

(Continued)

FOREIGN PATENT DOCUMENTS

| | | | |
|---|---|---|---|
| CN | 101414706 | A | 4/2009 |
| CN | 101640307 | A | 2/2010 |

(Continued)

*Primary Examiner* — Peguy Jean Pierre
(74) *Attorney, Agent, or Firm* — ScienBiziP, P.C.

(57) ABSTRACT

An antenna structure includes a first antenna with a first feed point feeding current, a first radiating portion, a second radiating portion, and a first ground point. The first radiating portion is electrically connected to the first feed point and receives radiation signals in a first frequency band. The second radiating portion is electrically connected to the first feed point and receives and sends radiation signals in a second frequency band. The first ground point is spaced apart from the first feed point and is electrically connected to the second radiating portion.

20 Claims, 12 Drawing Sheets

(56) References Cited

U.S. PATENT DOCUMENTS

| | | | | |
|---|---|---|---|---|
| 2016/0329629 | A1* | 11/2016 | Park | H01Q 1/243 |
| 2017/0162942 | A1* | 6/2017 | Wu | H01Q 1/48 |

FOREIGN PATENT DOCUMENTS

| | | | |
|---|---|---|---|
| CN | 201797038 | U | 4/2011 |
| CN | 105305028 | A | 2/2016 |

* cited by examiner

ANTENNA STRUCTURE AND WIRELESS COMMUNICATION DEVICE USING SAME

CROSS-REFERENCE TO RELATED APPLICATIONS

This application claims priority to Chinese Patent Application No. 201611206378.2 filed on Dec. 23, 2016, the contents of which are incorporated by reference herein.

FIELD

The subject matter herein generally relates to an antenna structure and a wireless communication device using the antenna structure.

BACKGROUND

Antennas are important components in wireless communication devices for receiving and transmitting wireless signals at different frequencies, such as signals in Long Term Evolution Advanced (LTE-A) frequency bands. However, the structure of the antenna is complicated and occupies a large space in the wireless communication device, which is inconvenient for miniaturization of the wireless communication device.

BRIEF DESCRIPTION OF THE DRAWINGS

Implementations of the present disclosure will now be described, by way of example only, with reference to the attached figures.

DETAILED DESCRIPTION

Figure 1:
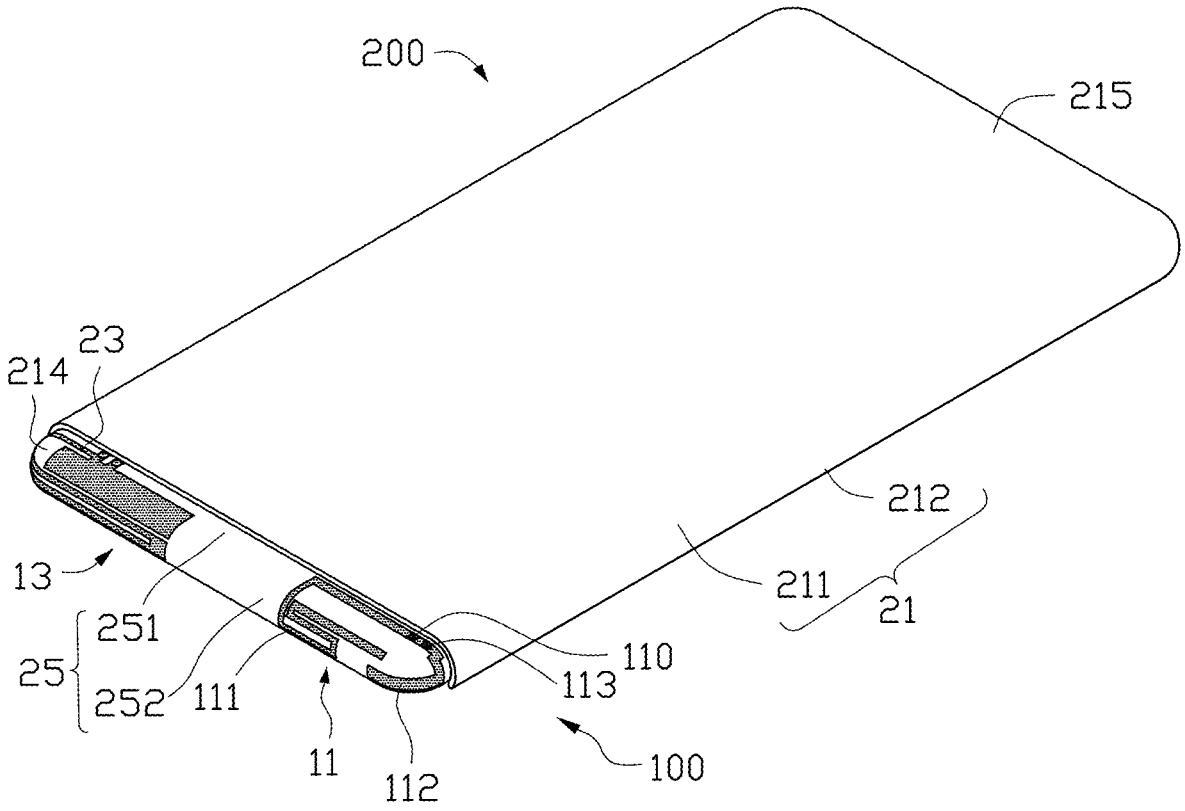
FIG. 1 is an isometric view of an exemplary embodiment of a wireless communication device using an exemplary antenna structure in accordance with the disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and a wireless communication device using same.

FIG. 1 illustrates an exemplary embodiment of a wireless communication device 200 using an antenna structure 100. The wireless communication device 200 can be a mobile phone or a personal digital assistant, for example. The antenna structure 100 can receive and transmit wireless signals.

The wireless communication device 200 further includes a housing 21. The housing 21 houses the wireless communication device 200. In this exemplary embodiment, the housing 21 includes a backboard 211 and a side frame 212. The backboard 211 and the side frame 212 can be integrally formed with each other. The side frame 212 is positioned around a periphery of the backboard 211. The side frame 212 forms a receiving space 213 (shown in FIG. 5) together with the backboard 211. The receiving space 213 can receive a baseboard, a printed circuit board, a processing unit, and other electronic components or modules (not shown).

The housing 21 further includes a first end portion 214 and a second end portion 215. In this exemplary embodiment, the first end portion 214 is a bottom portion of the wireless communication device 200 adjacent to a universal serial bus (USB) interface module (not shown). The second end portion 215 is a top portion of the wireless communication device 200 adjacent to a camera module (not shown). A surface of the first end portion 214 opposite to the receiving space 213 defines a groove 23 which forms a supporting portion 25 at the first end portion 214. The supporting portion 25 and the backboard 211 cooperatively form a step structure.

In this exemplary embodiment, the supporting portion 25 includes a first surface 251 and a second surface 252. A portion of the supporting portion 25 corresponding to the backboard 211 forms the first surface 251. A portion of the supporting portion 25 corresponding to the side frame 212 forms the second surface 252.

Figure 2:
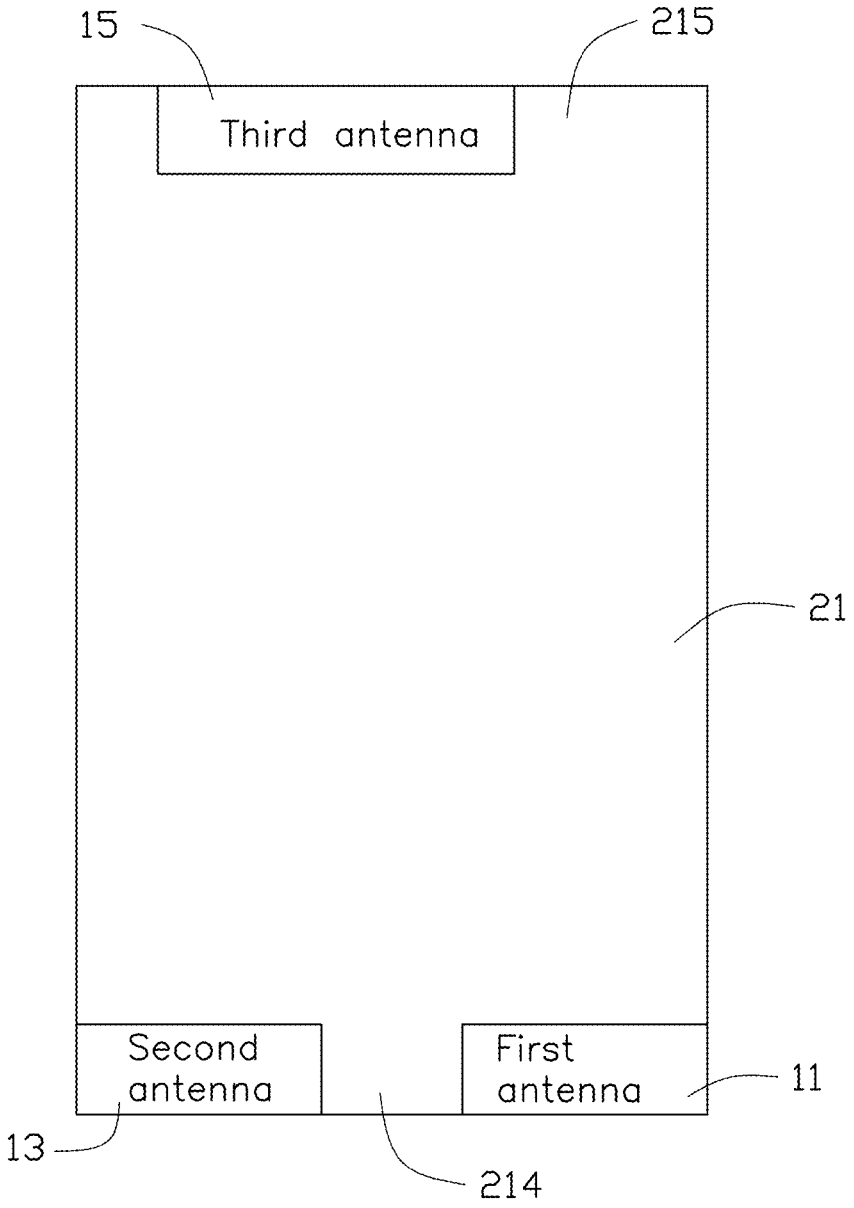
FIG. 2 is an isometric view of a first antenna, a second antenna, and a third antenna of the wireless communication device of FIG. 1.

As illustrated in FIG. 2, the antenna structure 100 includes a first antenna 11, a second antenna 13, and a third antenna 15. In this exemplary embodiment, the first antenna 11 and the second antenna 13 are positioned at the first end portion 214. The first antenna 11 and the second antenna 13 are spaced apart from each other. The third antenna 15 is positioned at the second end portion 215. The third antenna 15 is spaced apart from the first antenna 11 and the second antenna 13.

In this exemplary embodiment, the first antenna 11 is positioned at a right corner of the wireless communication device 200, that is, at the right side of the first end portion 214. The second antenna 13 is positioned at a left corner of the wireless communication device 200, that is, at the left side of the first end portion 214. The third antenna 15 is positioned at a top portion of the wireless communication device 200, that is, at the middle portion of the second end portion 215.

In other exemplary embodiments, locations of the first antenna 11, the second antenna 13, and the third antenna 15 can be adjustable to ensure that the first antenna 11 and the second antenna 13 are positioned at the bottom portion of the wireless communication device 200 (i.e., the first end portion 214), and the third antenna 15 can be positioned at the top portion of the wireless communication device 200 (i.e., the second end portion 215).

Figure 3:
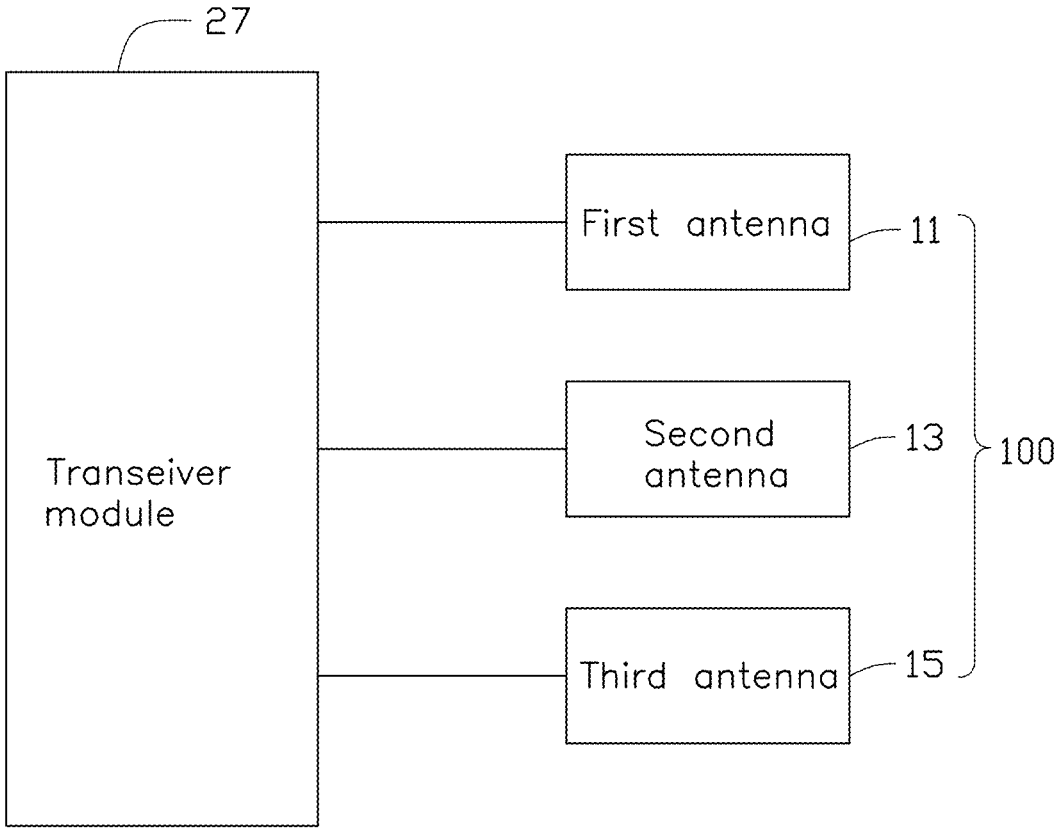
FIG. 3 is a block diagram of the wireless communication device of FIG. 1.

As illustrated in FIG. 3, the wireless communication device 200 further includes a radio frequency (RF) transceiver module 27. The first antenna 11, the second antenna 13, and the third antenna 15 are all electrically connected to the RF transceiver module 27 to communicate with the RF transceiver module 27, thereby realizing reception and transmission of wireless signals.

Figure 4:
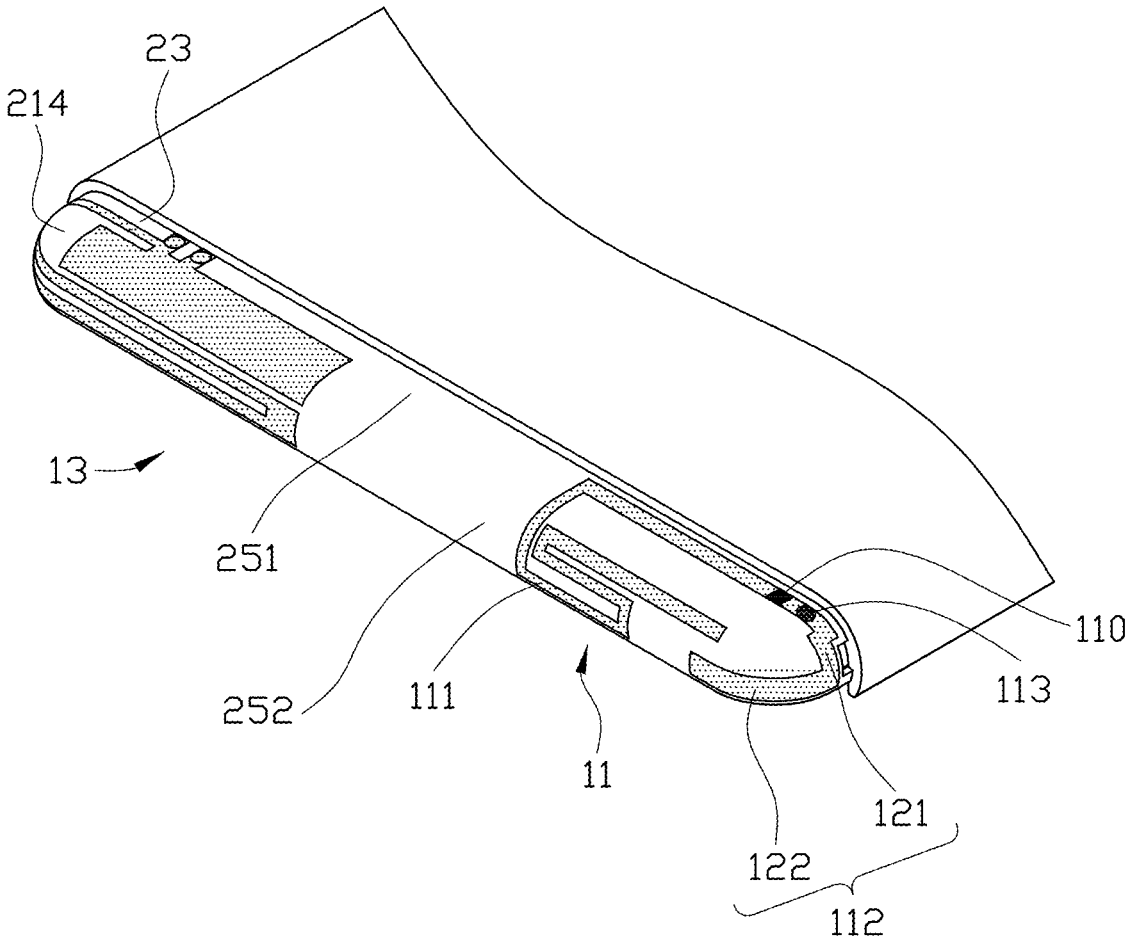
FIG. 4 is an isometric view of the first antenna and the second antenna of the antenna structure of FIG. 1.
Figure 5:
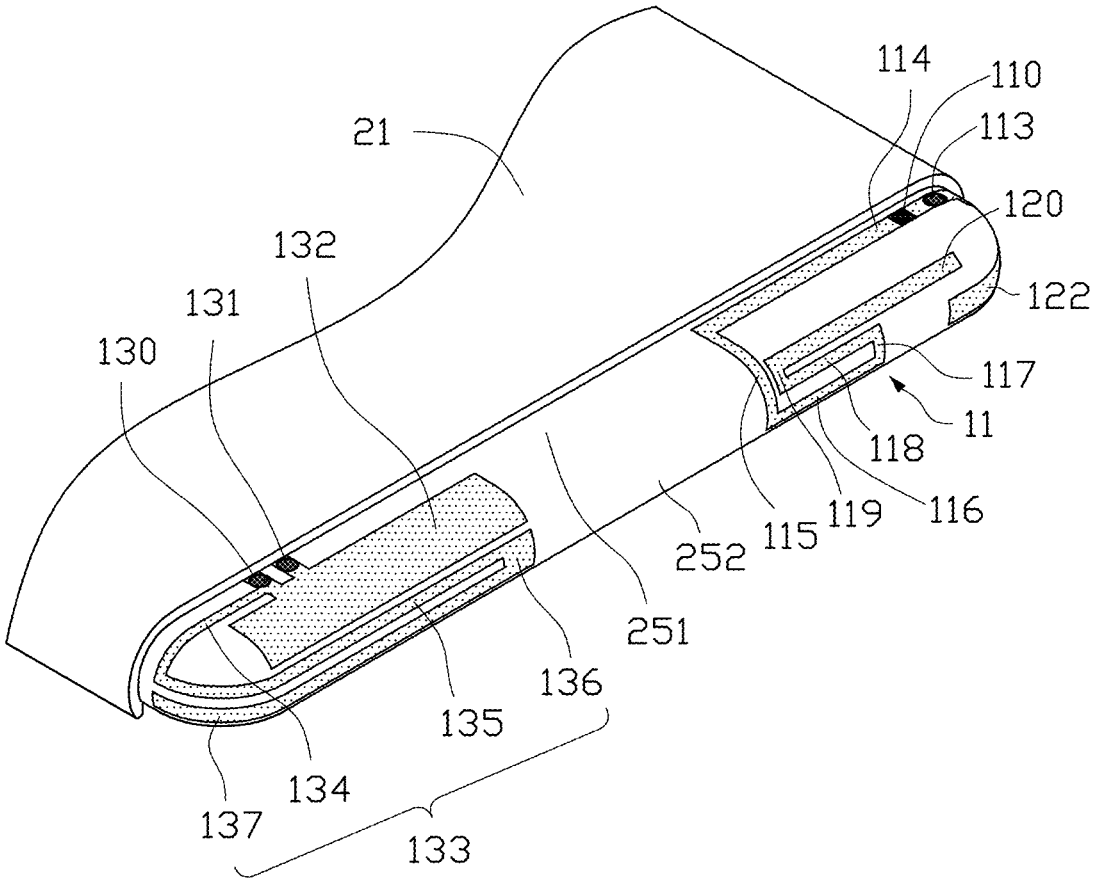
FIG. 5 is similar to FIG. 4, but shown from another angle.

As illustrated in FIG. 4 and FIG. 5, in this exemplary embodiment, the first antenna 11 is positioned on the supporting portion 25. The first antenna 11 includes a first feed point 110, a first radiating portion 111, a second radiating portion 112, and a first ground point 113. The first feed point 110 is positioned on the first surface 251. The first feed point 110 is electrically connected to a signal feed point (not shown) of the RF transceiver module 27 to feed current to the first antenna 11.

The first radiating portion 111 is an auxiliary antenna. The first radiating portion 111 is multi-curved. The first radiating portion 111 is positioned on the first surface 251 and the second surface 252. The first radiating portion 111 includes a first radiating section 114, a second radiating section 115, a third radiating section 116, a fourth radiating section 117, a fifth radiating section 118, a sixth radiating section 119, and a seventh radiating section 120, connected in that order.

The first radiating section 114 is substantially rectangular and is positioned at the first surface 251. The first radiating section 114 is electrically connected to the first feed point 110. The second radiating section 115 is substantially rectangular and is positioned at the first surface 251. One end of the second radiating section 115 is perpendicularly connected to the end of the first radiating section 114 away from the first feed point 110 and extends along a direction towards the second surface 252.

The third radiating section 116 is substantially rectangular and is positioned at the second surface 252. One end of the third radiating section 116 is perpendicularly connected to the end of the second radiating section 115 away from the first radiating section 114. Another end of the third radiating section 116 extends along a direction parallel to the first radiating section 114 and towards the first feed point 110.

In this exemplary embodiment, the first radiating section 114 and the third radiating section 116 are positioned at same side of the second radiating section 115. The first radiating section 114, the second radiating section 115, and the third radiating section 116 cooperatively form a U-shaped structure. The first radiating section 114 is longer than the third radiating section 116.

The fourth radiating section 117 is substantially rectangular and is positioned at the first surface 251. One end of the fourth radiating section 117 is perpendicularly connected to one end of the third radiating section 116 away from the second radiating section 115. Another end of the fourth radiating section 117 extends along a direction parallel to the second radiating section 115 and towards the first radiating section 114. In this exemplary embodiment, the fourth radiating section 117 is shorter than the second radiating section 115.

The fifth radiating section 118 is substantially rectangular and is positioned at the first surface 251. One end of the fifth radiating section 118 is perpendicularly connected to the end of the fourth radiating section 117 away from the third radiating section 116. Another end of the fifth radiating section 118 extends along a direction parallel to the first radiating section 114 and towards the second radiating section 115. The fifth radiating section 118 is shorter than the third radiating section 116.

The sixth radiating section 119 is substantially rectangular and is positioned at the first surface 251. One end of the sixth radiating section 119 is perpendicularly connected to the end of the fifth radiating section 118 away from the fourth radiating section 117. Another end of the sixth radiating section 119 extends along a direction parallel to the second radiating section 115 and towards the first radiating section 114. In this exemplary embodiment, the sixth radiating section 119 is shorter than the fourth radiating section 117.

The seventh radiating section 120 is substantially rectangular. One end of the seventh radiating section 120 is perpendicularly connected to one end of the sixth radiating section 119 away from the fifth radiating section 118. Another end of the seventh radiating section 120 extends along a direction parallel to the first radiating section 114 and away from the second radiating section 115. In this exemplary embodiment, the seventh radiating section 120 is longer than the third radiating section 114 and is shorter than the fourth radiating section 117. The first radiating section 114, the third radiating section 116, the fourth radiating section 117, the fifth radiating section 118, the sixth radiating section 119, and the seventh radiating section 120 are all positioned at a same side of the second radiating section 115.

The second radiating portion 112 is a main antenna. The second radiating portion 112 is shorter than the first radiating portion 111. The second radiating portion 112 includes a first radiating arm 121 and a second radiating arm 122. The first radiating arm 121 is positioned at the first surface 251. One end of the first radiating arm 121 forms a curved connection with one side of the first feed point 110 away from the first radiating section 114. Another end of the first radiating arm 121 extends along a direction away from the first radiating section 114 and towards the second surface 252. The second radiating arm 122 is substantially a curved sheet. One end of the second radiating arm 122 forms a curved connection with one end of the first radiating arm 121 away from the first ground point 113. Another end of the second radiating arm 122 extends towards the third radiating section 116. In this exemplary embodiment, the first radiating arm 121 is shorter than the second radiating arm 122.

The first ground point 113 is positioned on the first radiating portion 111. The first ground point 113 is positioned at one end of the first radiating section 114 towards the first radiating arm 121. The first ground point 113 is electrically connected to a ground point (not shown) of the RF transceiver module 27. The first ground point 113 is further electrically connected to the first radiating portion 111 to ground the first antenna 11.

When the first feed point 110 supplies current, the current flows through the first radiating section 114, the second radiating section 115, the third radiating section 116, the fourth radiating section 117, the fifth radiating section 118, the sixth radiating section 119, and the seventh radiating section 120. The current further flows to the ground through the first ground point 113. Then the first radiating portion 111 can only receive radiation signals in a first frequency band. The current flowing through the first feed point 110 further flows through the first radiating arm 121 and the second radiating arm 122. The second radiating portion 112 can receive and send radiation signals in a second frequency band. In this exemplary embodiment, the first frequency band is a low frequency band and has a frequency of about 729-960 MHz. The second frequency band is a higher frequency band and has a frequency of about 2300-2700 MHz.

As illustrated in FIG. 5, the second antenna 13 is positioned on the supporting portion 25 and is spaced apart from the first antenna 11. The second antenna 13 is a main antenna. In this exemplary embodiment, the second antenna 13 includes a second feed point 130, a second ground point 131, a first extending portion 132, and a second extending portion 133. The second feed point 130 is positioned on the first surface 251. The second feed point 130 is positioned at one side of the first feed point 110 away from the first ground point 113. The second feed point 130 is spaced apart from the first feed point 110. The second feed point 130 is electrically connected to the signal feed point of the RF transceiver module 27 to feed current to the second antenna 13.

The second ground point 131 is positioned at the first surface 251. The second ground point 131 is positioned between the first feed point 110 and the second feed point 130. The second ground point 131 is electrically connected to the ground point of the RF transceiver module 27 to ground the second antenna 13.

The first extending portion 132 is substantially rectangular and is positioned on the first surface 251. One end of the first extending portion 132 is perpendicularly connected to the second feed point 130 and the second ground point 131. Another end of the first extending portion 132 extends along a direction parallel to the second radiating section 114 and towards the third radiating section 115. In this exemplary embodiment, the first extending portion 132 is wider than the second radiating section 115.

The second extending portion 133 includes a first extending section 134, a second extending section 135, a third extending section 136, and a fourth extending section 137. The first extending section 134 is substantially rectangular and is positioned on the first surface 251. One end of the first extending section 134 is perpendicularly connected to one side of the second feed point 130 away from the second ground point 131. Another end of the first extending section 134 extends along a direction parallel to the first extending portion 132 and away from the first radiating section 114 and the second radiating section 115.

The second extending section 135 is substantially a curved sheet and is positioned on the first surface 251. One end of the second extending section 135 forms a curved connection with one end of the first extending section 134 away from the second feed point 130. Another end of the second extending section 135 extends along a direction parallel to the first radiating section 114 and towards the second radiating section 115.

The third extending section 136 is substantially rectangular and is positioned on the first surface 251. One end of the third extending section 136 is perpendicularly connected to one end of the second extending section 135 away from the first extending section 134. Another end of the third extending section 136 extends along a direction parallel to the third radiating section 115 and towards the second surface 252. The fourth extending section 137 is substantially a curved sheet and is positioned on the second surface 252. One end of the fourth extending section 137 is perpendicularly connected to one end of the third extending section 136 away from the second extending section 135. Another end of the fourth extending section 137 extends along a direction parallel to the second extending section 135 and away from the third radiating section 116.

In this exemplary embodiment, the second extending portion 133 is longer than the first extending portion 132. When the second feed point 130 supplies current, the current flows through the first extending portion 132. Then the first extending portion 132 can receive and send radiation signals in a third frequency band. The current flowing through the second feed point 130 further flows through the first extending section 134, the second extending section 135, the third extending section 136, and the fourth extending section 137 of the second extending portion 133. The current reaches ground through the second feed point 130. The second extending portion 133 can receive and send radiation signals in a fourth frequency band. In this exemplary embodiment, the third frequency band is a middle frequency band and has a frequency of about 1710-2170 MHz. The fourth frequency band is a lower frequency band and has a frequency of about 824-894 MHz.

Figure 6:
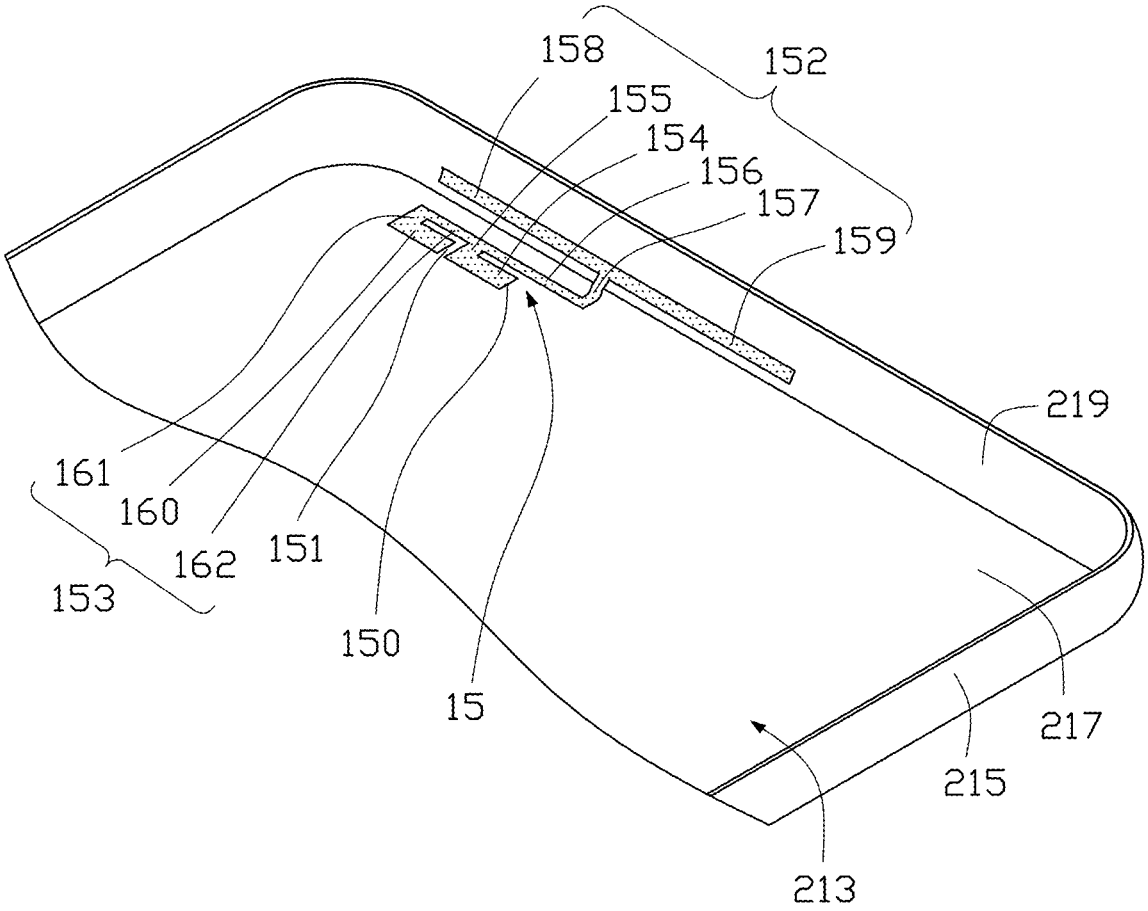
FIG. 6 is an isometric view of the third antenna and the second antenna of the antenna structure of FIG. 1.

As illustrated in FIG. 6, the third antenna 15 is an auxiliary antenna and is position inside of the receiving space 213. The receiving space 213 includes a bottom wall 217 and a side wall 219 surrounding a periphery of the bottom wall 217. The third antenna 15 is positioned on the bottom wall 217 and extends to the side wall 219. The third antenna 15 includes a third feed point 150, a third ground point 151, a first coupling portion 152, and a second coupling portion 153. The third feed point 150 is positioned on the bottom wall 217 and is electrically connected to the signal feed point of the RF transceiver module 27 for feeding current to the third antenna 15. The third ground point 151 is positioned on the bottom wall 217 and is spaced apart from the third feed point 150. The third ground point 151 is electrically connected to the ground point of the RF transceiver module 27 for grounding the third antenna 15.

The first coupling portion 152 includes a first coupling arm 154, a second coupling arm 155, a third coupling arm 156, a fourth coupling arm 157, a fifth coupling arm 158, and a sixth coupling arm 159. The first coupling arm 154 is substantially rectangular. One end of the first coupling arm 154 is electrically connected to the third feed point 150. The second coupling arm 155 is substantially rectangular and is positioned on the bottom wall 217 of the receiving space 213. The second coupling arm 155 is perpendicularly connected to one end of the first coupling arm 154 away from the third feed point 150 and extends towards the side wall 219 of the receiving space 213.

The third coupling arm 156 is substantially rectangular and is positioned on the bottom wall 217 of the receiving space 213. One end of the third coupling arm 156 is perpendicularly connected to one end of the second coupling arm 155 away from the first coupling arm 154. Another end of the third coupling arm 156 extends along a direction parallel to the first coupling arm 154 and away from the third ground point 151. The extension continues until the third coupling arm 156 passes over the third feed point 150. In this exemplary embodiment, the third coupling arm 156 is longer than the first coupling arm 154.

The fourth coupling arm 157 is substantially rectangular and is positioned on the side wall 219 of the receiving space 213. The fourth coupling arm 157 forms a curved connection with one end of the third coupling arm 156 away from the second coupling arm 155 and extends to the side wall 219.

The fifth coupling arm 158 and the sixth coupling arm 159 are both positioned on the side wall 219 of the receiving space 213. The fifth coupling arm 158 and the sixth coupling arm 159 are both rectangular. The fifth coupling arm 158 and the sixth coupling arm 159 are both perpendicularly connected to one end of the fourth coupling arm 157 away from the third coupling arm 156 and extend in opposite directions. In this exemplary embodiment, the fifth coupling arm 158 is collinear with the sixth coupling arm 159. A length of the fifth coupling arm 158 is substantially equal to a length of the sixth coupling arm 159. The fifth coupling arm 158, the sixth coupling arm 159, and the fourth coupling arm 157 cooperatively form a T-shaped structure.

The second coupling portion 153 is positioned on the bottom wall 217 of the receiving space 213. The second coupling portion 153 includes a first coupling section 160, a second coupling section 161, and a third coupling section 162. The first coupling section 160 is substantially rectangular. The first coupling section 160 is electrically connected to the third ground point 151 and extends away from the first coupling arm 154.

The second coupling section 161 is substantially rectangular. One end of the second coupling section 161 is perpendicularly connected to one end of the first coupling section 160 away from the third ground point 151. Another end of the second coupling section 161 extends along a direction parallel to the second coupling arm 155 and towards the side wall 219 of the receiving space 213. The third coupling section 162 is substantially rectangular. One end of the third coupling section 162 is perpendicularly connected to one end of the second coupling section 161 away from the first coupling section 160. Another end of the third coupling section 162 extends along a direction parallel to the first coupling section 160 and towards the first coupling portion 152. The extension continues until the third coupling section 162 is perpendicularly connected to a junction of the second coupling arm 155 and the third coupling arm 156.

In this exemplary embodiment, the first coupling portion 152 is longer than the second coupling portion 153. When the third feed point 150 supplies current, the current flows through the first coupling arm 154, the second coupling arm 155, the third coupling arm 156, the fourth coupling arm 157, and the sixth coupling arm 159. Then the first coupling portion 152 can only receive radiation signals in a fifth frequency band. The current flowing through the third feed point 150 further flows through the first coupling arm 154, the second coupling arm 155, the third coupling arm 156, the fourth coupling arm 157, and the fifth coupling arm 158. Then the first coupling portion 152 can only receive radiation signals in a sixth frequency band. In this exemplary embodiment, the fifth frequency band is a middle frequency band. The sixth frequency band is a high frequency band. The fifth frequency band and the sixth frequency band have different frequencies within a range of 1805-2690 MHz.

Figure 7:
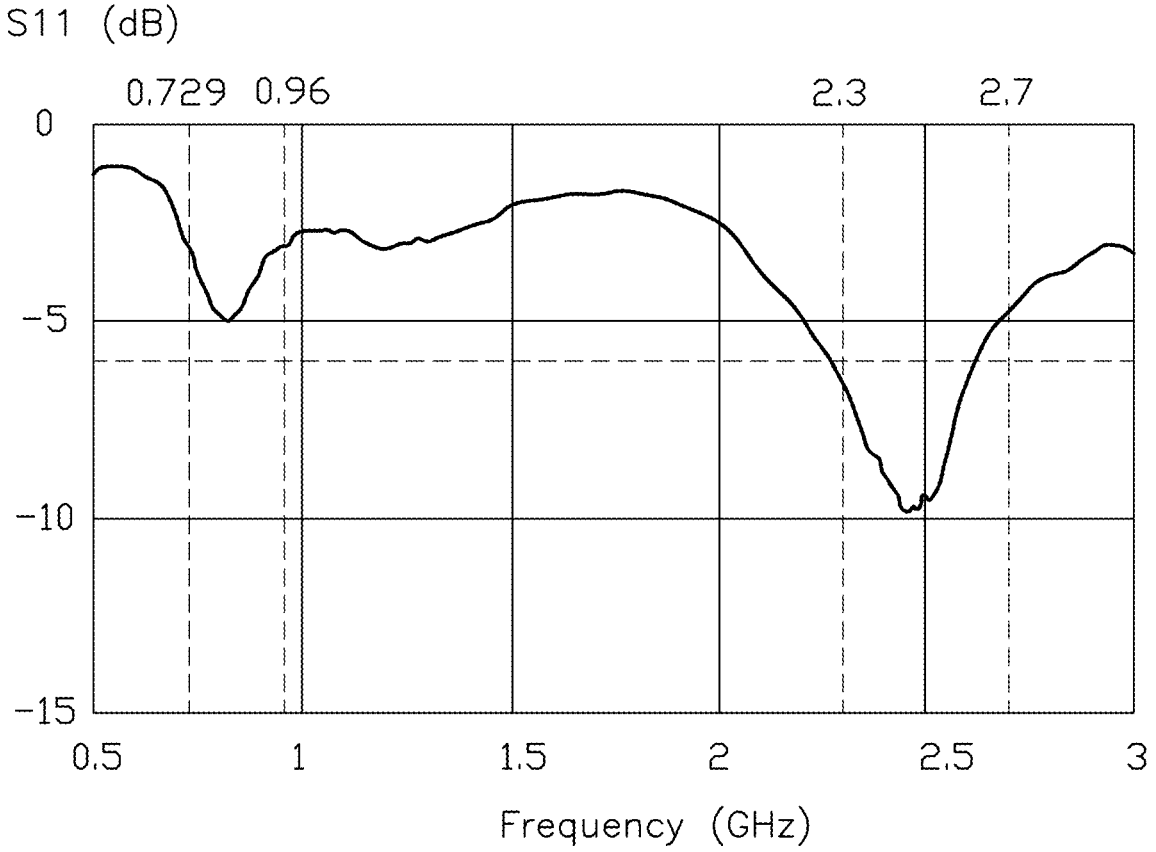
FIG. 7 is a scattering parameter graph of the first antenna of FIG. 5.
Figure 8:
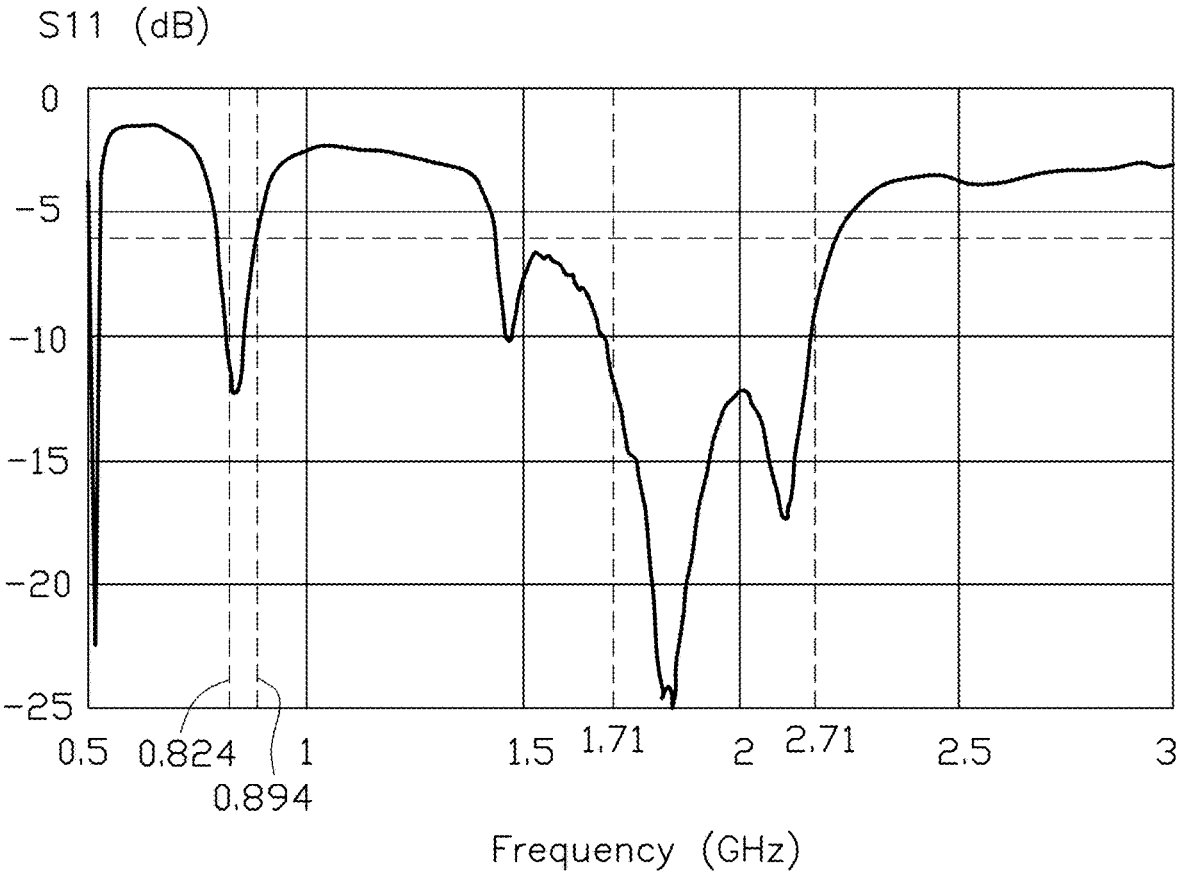
FIG. 8 is a scattering parameter graph of the second antenna of FIG. 5.
Figure 9:
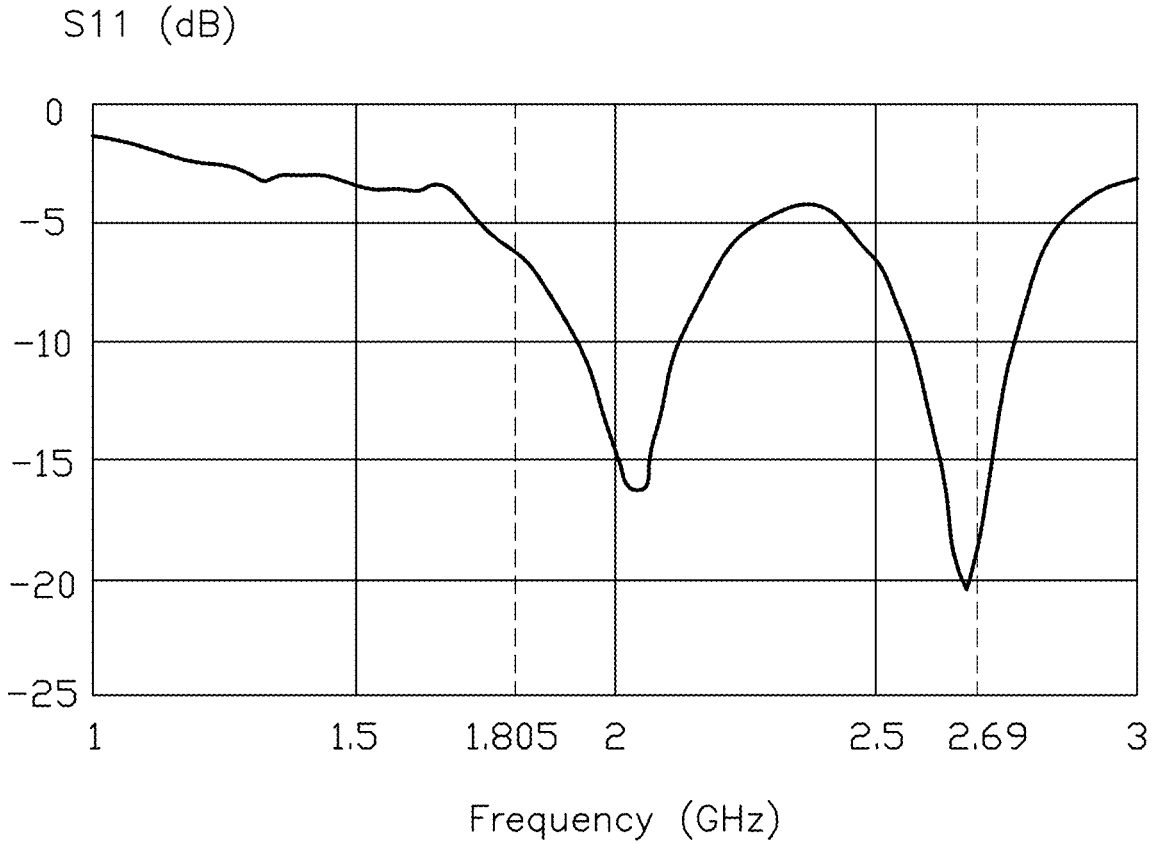
FIG. 9 is a scattering parameter graph of the third antenna of FIG. 6.

FIG. 7 illustrates a scattering parameter graph of the first antenna 11. FIG. 8 illustrates a scattering parameter graph of the second antenna 13. FIG. 9 illustrates a scattering parameter graph of the third antenna 15. As FIGS. 7-9 show, the antenna structure 100 has a good bandwidth and satisfies a design of the antenna.

Figure 10:
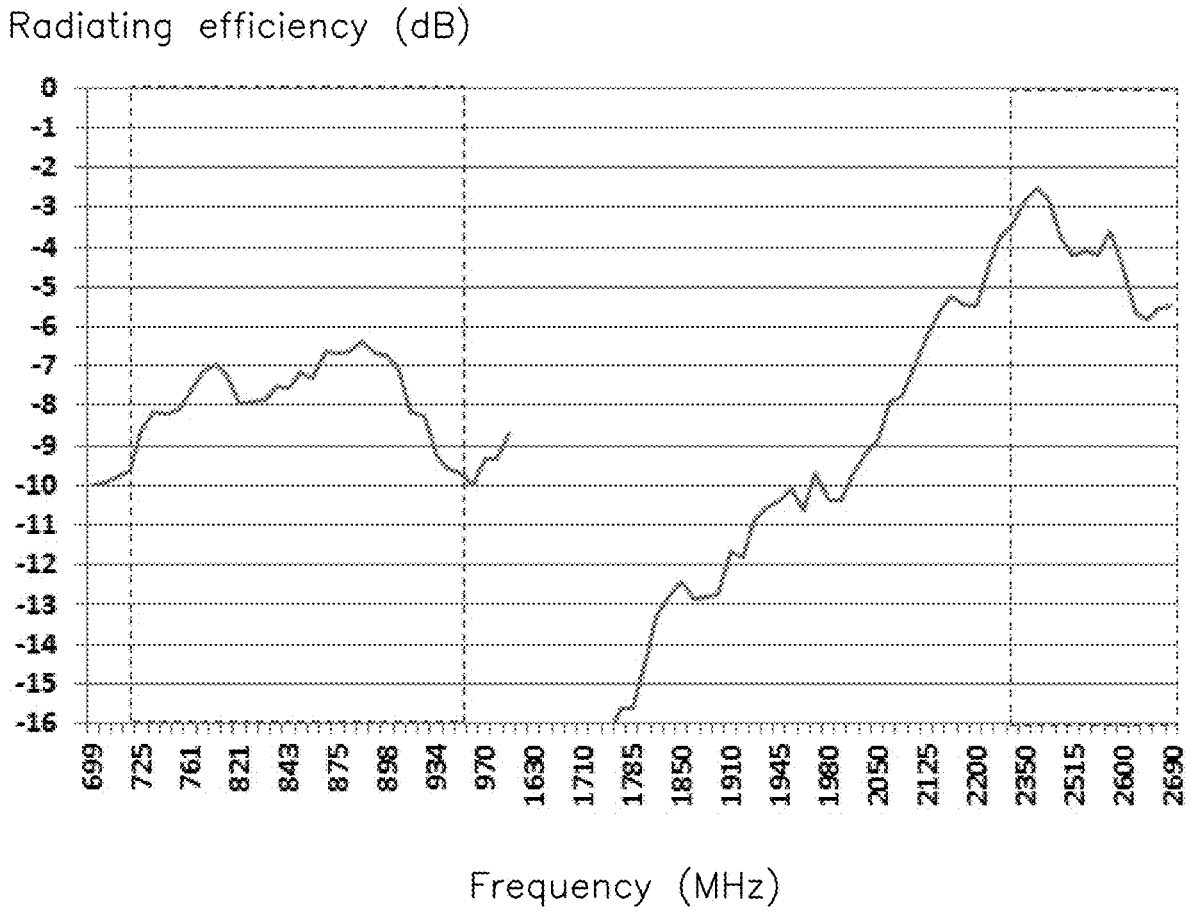
FIG. 10 is a radiating efficiency graph of the first antenna of FIG. 5.
Figure 11:
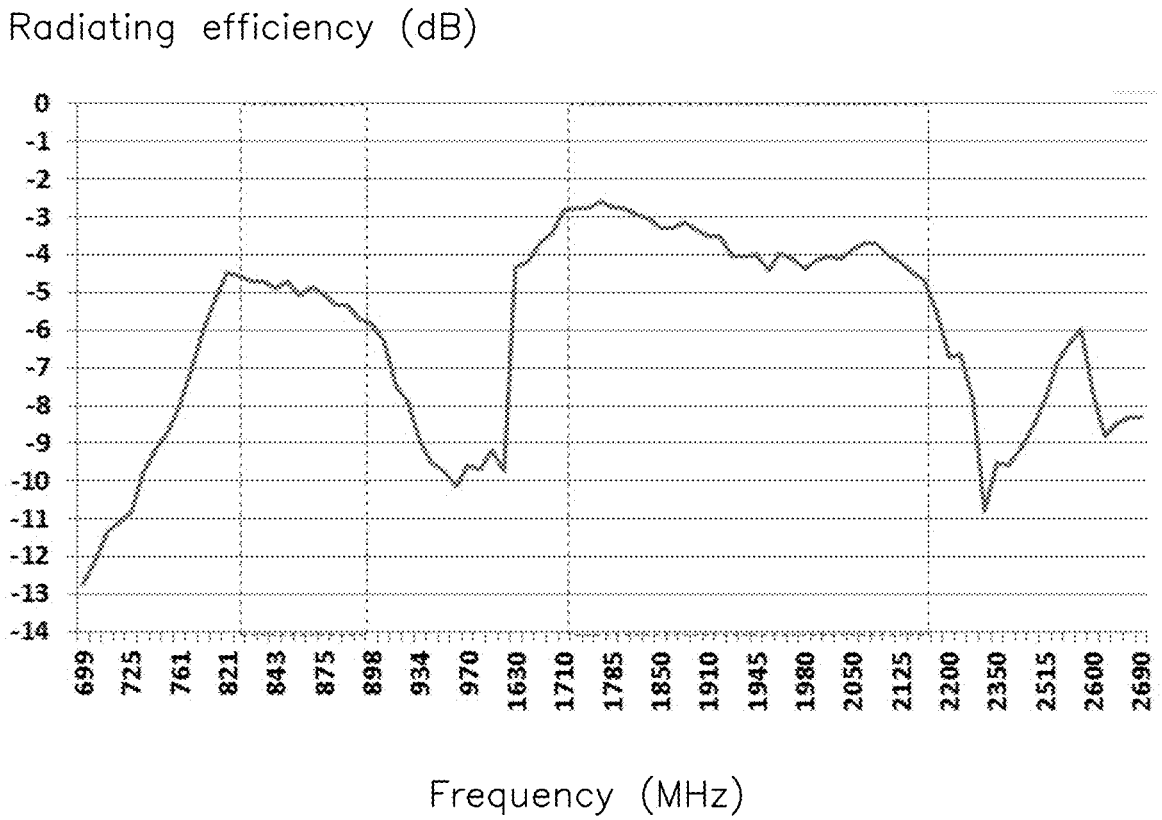
FIG. 11 is a radiating efficiency graph of the second antenna of FIG. 5.
Figure 12:
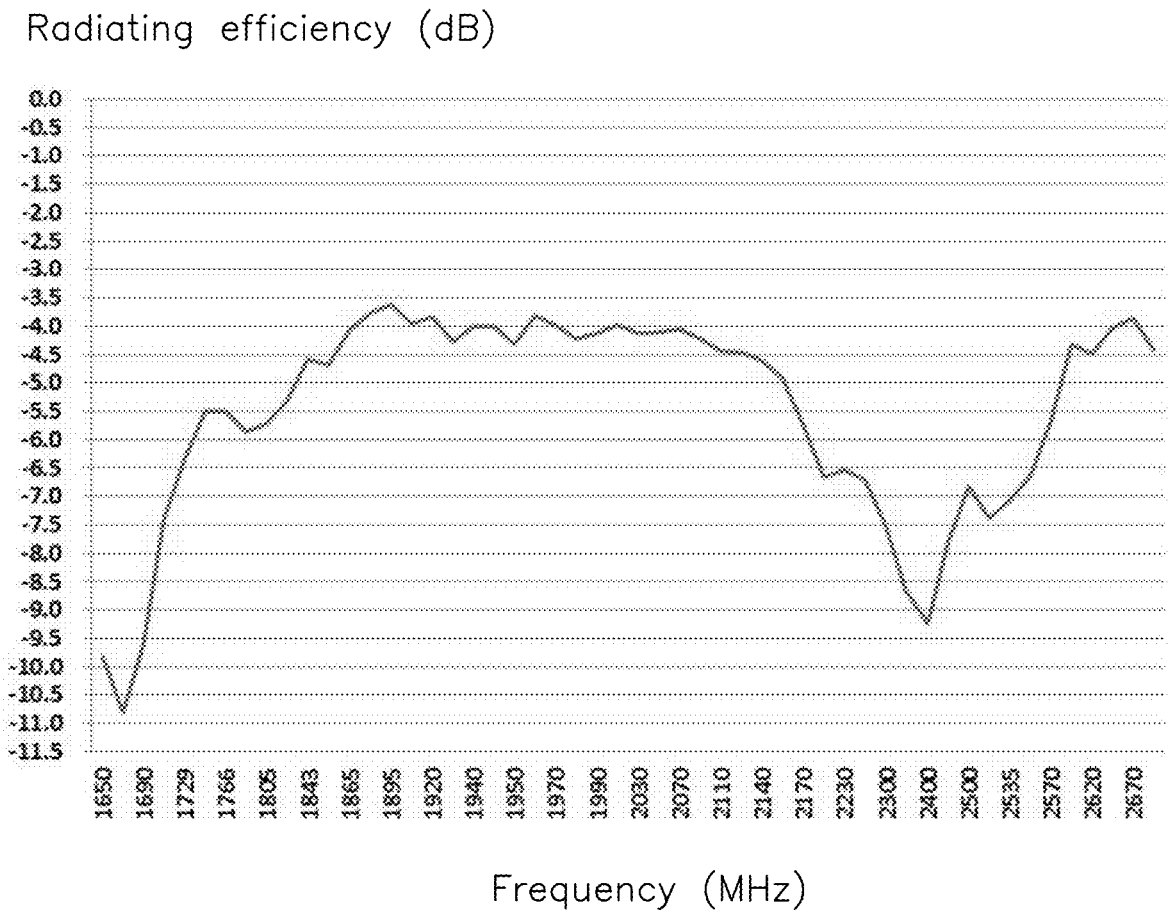
FIG. 12 is a radiating efficiency graph of the third antenna of FIG. 6.

FIG. 10 illustrates a radiating efficiency graph of the first antenna 11. FIG. 11 illustrates a radiating efficiency graph of the second antenna 13. FIG. 12 illustrates a radiating efficiency graph of the third antenna 15. The antenna structure 100 can operate in a plurality of communication systems and has a good radiation efficiency, which satisfies a design of the antenna.

The following table 1 illustrates an envelope correlation coefficient (ECC) of the antenna structure 100 when the antenna structure 100 works at different frequencies. The lower the frequency band, the lower is the ECC of the antenna structure 100.

TABLE 1

| Frequency (MHz) | ECC |
|---|---|
| 734 | 0.470 |
| 740 | 0.459 |
| 746 | 0.426 |
| 751 | 0.403 |
| 756 | 0.395 |
| 791 | 0.173 |
| 806 | 0.177 |
| 821 | 0.177 |
| 869 | 0.247 |
| 880 | 0.237 |
| 894 | 0.217 |
| 925 | 0.145 |
| 942 | 0.112 |
| 960 | 0.076 |
| 1805 | 0.007 |
| 1843 | 0.003 |
| 1880 | 0.003 |
| 1930 | 0.009 |
| 1960 | 0.015 |
| 1990 | 0.020 |
| 2110 | 0.014 |
| 2140 | 0.027 |
| 2170 | 0.047 |
| 2620 | 0.041 |
| 2655 | 0.040 |
| 2690 | 0.036 |

Each antenna of the antenna structure 100 has a separate signal feed point, for example, the first antenna 11 has the first feed point 110, the second antenna 13 has the second feed point 130, and the third antenna 15 has the third feed point 150. As a result, the three antennas do not interfere with each other, and each antenna can operate in at least two frequency bands, thereby the antenna structure 100 has a wide bandwidth. The antenna structure 100 also can use carrier aggregation (CA) function of LTE-Advanced (LTE-A) and also have a low ECC. Furthermore, compared to conventional antennas, the antenna structure 100 only needs the three antennas to achieve a broadband capability. Space in the wireless communication device 200 is thus saved and the antenna design is more flexible.

In this exemplary embodiment, the second radiating portion 112 of the first antenna 11 and the second antenna 13 are both main antennas. Then the second radiating portion 112 of the first antenna 11 and the second antenna 13 can be used to receive and send radiation signals in corresponding frequency bands. For example, at the least, the second radiating portion 112 of the first antenna 11 and the second antenna 13 can work at the second frequency band (2300-2700 MHz), in the third frequency band (1710-2170 MHz), and in the fourth frequency band (824-894 MHz). That is, the second radiating portion 112 of the first antenna 11 and the second antenna 13 can cooperatively cover the low, middle, and high frequency bands.

The third antenna 15 of the antenna structure 100 and the first radiating portion 111 of the first antenna 11 are both auxiliary antennas. The third antenna 15 and the first radiating portion 111 of the first antenna 11 can be used to receive radiation signals in corresponding frequency bands. For example, the third antenna 15 and the first radiating portion 111 of the first antenna 11 can, at the least, work at the first frequency band (729-960 MHz), and at the fifth and sixth frequency bands (1805-2690 MHz). That is, the third antenna 15 and the first radiating portion 111 of the first antenna 11 can also cooperatively cover the low, middle, and high frequency bands.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a first antenna, the first antenna comprising:

a first feed point configured for feeding current to the first antenna;

a first radiating portion electrically connected to the first feed point and configured for receiving radiation signals in a first frequency band;

a second radiating portion electrically connected to the first feed point, and configured for sending radiation signals in a second frequency band; and a first ground point spaced apart from the first feed point and electrically connected to the second radiating portion;

a second antenna spaced apart from the first antenna, the first antenna and the second antenna positioned on a first end portion of a housing; and a third antenna spaced apart from the first antenna and the second antenna, the third antenna positioned on a second end portion of the housing, the second end portion opposite to the first end portion;

wherein the housing further comprises an inner surface and an outer surface opposite to the inner surface, the outer surface defines a groove forming a supporting portion at the first end portion, the first antenna and the second antenna are positioned on the supporting portion, the third antenna is positioned at the inner surface, a radiation direction of the third antenna is opposite to radiation directions of the first and the second antennas.

2. The antenna structure of claim 1, wherein the first radiating portion comprises a first radiating section, a second radiating section, a third radiating section, a fourth radiating section, a fifth radiating section, a sixth radiating section, and a seventh radiating section, the first radiating section is electrically connected to the first feed point; wherein one end of the second radiating section is perpendicularly connected to one end of the first radiating section away from the first feed point, one end of the third radiating section is perpendicularly connected to one end of the second radiating section away from the first radiating section, another end of the third radiating section extends along a direction parallel to the first radiating section and towards the first feed point; wherein one end of the fourth radiating section is perpendicularly connected to the end of the third radiating section away from the second radiating section, another end of the fourth radiating section extends along a direction parallel to the second radiating section and towards the first radiating section; wherein one end of the fifth radiating section is perpendicularly connected to the end of the fourth radiating section away from the third radiating section, another end of the fifth radiating section extends along a direction parallel to the first radiating section and towards the second radiating section; wherein one end of the sixth radiating section is perpendicularly connected to the end of the fifth radiating section away from the fourth radiating section, another end of the sixth radiating section extends along a direction parallel to the second radiating section and towards the first radiating section; wherein one end of the seventh radiating section is perpendicularly connected to the end of the sixth radiating section away from the fifth radiating section, another end of the seventh radiating section extends along a direction parallel to the first radiating section and away from the second radiating section.

3. The antenna structure of claim 2, wherein the second radiating portion is shorter than the first radiating portion, the second radiating portion comprises a first radiating arm and a second radiating arm, one end of the first radiating arm forms a curved connection with one side of the first ground point away from the first radiating section, another end of the first radiating arm extends away from the first radiating section; wherein one end of the second radiating arm forms a curved connection with the end of the first radiating arm away from the first ground point, another end of the second radiating arm extends towards the third radiating section.

4. The antenna structure of claim 2, wherein the second antenna comprises a second feed point, a second ground point, a first extending portion, and a second extending portion; wherein the second feed point is positioned at one side of the first feed point away from the first ground point and is spaced apart from the first feed point, the second ground point is positioned between the first feed point and the second feed point; wherein the first extending portion is electrically connected to the second feed point and the second ground point to receive and send radiation signals in a third frequency band; wherein the second extending portion is electrically connected to the second feed point to receive and send radiation signals in a fourth frequency band.

5. The antenna structure of claim 4, wherein one end of the first extending portion is perpendicularly connected to the second feed point and the second ground point, another end of the first extending portion extends along a direction parallel to the second radiating section and towards the third radiating section.

6. The antenna structure of claim 5, wherein the second extending portion comprises a first extending section, a second extending section, a third extending section, and a fourth extending section, one end of the first extending section is perpendicularly connected to one side of the second feed point away from the second ground point, another end of the first extending section extends along a direction parallel to the first extending portion and away from the first radiating section and the second radiating section; wherein one end of the second extending section forms a curved connection with the end of the first extending section away from the second feed point, another end of the second extending section extends along a direction parallel to the first radiating section and towards the second radiating section; wherein one end of the third extending section is perpendicularly connected to the end of the second extending section away from the first extending section, another end of the third extending section extends along a direction parallel to the second radiating section and towards the third radiating section; wherein one end of the fourth extending section is perpendicularly connected to the end of the third extending section away from the second extending section, another end of the fourth extending section extends along a direction parallel to the second extending section and away from the third radiating section.

7. The antenna structure of claim 4, wherein the third antenna comprises a third feed point, a third ground point, a first coupling portion, and a second coupling portion, the first coupling portion is electrically connected to the third feed point, the second coupling portion is electrically connected to the third ground point and the first coupling portion, the first coupling portion receives radiation signals in a fifth frequency band and a sixth frequency band.

8. The antenna structure of claim 7, wherein a frequency of the first frequency band is lower than frequencies of the fifth frequency band and the sixth frequency band, a frequency of the second frequency band is higher than a frequency of the third frequency band; and the frequency of the third frequency band is higher than a frequency of the fourth frequency band.

9. The antenna structure of claim 7, wherein the first coupling portion comprises a first coupling arm, a second coupling arm, a third coupling arm, a fourth coupling arm, a fifth coupling arm, and a sixth coupling arm, one end of the first coupling arm is electrically connected to the third feed point, the second coupling arm is perpendicularly connected to one end of the first coupling arm away from the third feed point; wherein one end of the third coupling arm is perpendicularly connected to one end of the second coupling arm away from the first coupling arm, another end of the third coupling arm extends along a direction parallel to the first coupling arm and away from the third ground point until the third coupling arm passes over the third feed point; wherein the fourth coupling arm forms a curved connection with the end of the third coupling arm away from the second coupling arm, the fifth coupling arm and the sixth coupling arm are both perpendicularly connected to one end of the fourth coupling arm away from the third coupling arm and extend in opposite directions, the fifth coupling arm, the sixth coupling arm, and the fourth coupling arm cooperatively form a T-shaped structure.

10. The antenna structure of claim 9, wherein the second coupling portion comprises a first coupling section, a second coupling section, and a third coupling section, the first coupling section is electrically connected to the third ground point and extends away from the first coupling arm; wherein the second coupling section is perpendicularly connected to one end of the first coupling section away from the third ground point and extends along a direction parallel to the second coupling arm; wherein one end of the third coupling section is perpendicularly connected to one end of the second coupling section away from the first coupling section, another end of the third coupling section extends along a direction parallel to the first coupling section and towards the first coupling portion until the third coupling section is perpendicularly connected to a junction of the second coupling arm and the third coupling arm.

11. A wireless communication device comprising:

a housing comprising a first end portion, a second end portion opposite to the first end portion, an inner surface, an outer surface opposite to the inner surface, a groove defined on the outer surface, and a supporting portion formed in the groove at the first end portion; and an antenna structure, the antenna structure comprising:

a first antenna positioned at the first end portion, and configured for receiving radiation signals in a first frequency band, and receiving and sending radiation signals in a second frequency band;

a second antenna positioned at the first end portion and spaced apart from the first antenna, the second antenna being configured for receiving and sending radiation signals in a third frequency band and a fourth frequency band, the first antenna and the second antenna being positioned on the supporting portion; and a third antenna positioned at the second end portion of the inner surface, configured for receiving radiation signals in a fifth frequency band and a sixth frequency band, the third antenna being spaced apart from the first antenna and the second antenna, wherein a radiation direction of the third antenna is opposite to radiation directions of the first and the second antennas.

12. The wireless communication device of claim 11, wherein the housing comprises a backboard and a side frame, the side frame is positioned around a periphery of the backboard and forms a receiving space together with the backboard; wherein a surface of the first end portion opposite to the receiving space defines a groove to form a supporting portion at the first end portion, the first antenna and the second antenna are positioned on the supporting portion, and the third antenna is positioned inside the receiving space.

13. The wireless communication device of claim 11, wherein a frequency of the first frequency band is lower than frequencies of the fifth frequency band and the sixth frequency band, a frequency of the second frequency band is higher than a frequency of the third frequency band; and the frequency of the third frequency band is higher than a frequency of the fourth frequency band.

14. The wireless communication device of claim 11, wherein the first antenna comprises a first radiating portion, the first radiating portion comprises a first radiating section, a second radiating section, a third radiating section, a fourth radiating section, a fifth radiating section, a sixth radiating section, and a seventh radiating section, the first radiating section is electrically connected to the first feed point; wherein one end of the second radiating section is perpendicularly connected to one end of the first radiating section away from the first feed point, one end of the third radiating section is perpendicularly connected to one end of the second radiating section away from the first radiating section, another end of the third radiating section extends along a direction parallel to the first radiating section and towards the first feed point; wherein one end of the fourth radiating section is perpendicularly connected to the end of the third radiating section away from the second radiating section, another end of the fourth radiating section extends along a direction parallel to the second radiating section and towards the first radiating section; wherein one end of the fifth radiating section is perpendicularly connected to the end of the fourth radiating section away from the third radiating section, another end of the fifth radiating section extends along a direction parallel to the first radiating section and towards the second radiating section; wherein one end of the sixth radiating section is perpendicularly connected to the end of the fifth radiating section away from the fourth radiating section, another end of the sixth radiating section extends along a direction parallel to the second radiating section and towards the first radiating section; wherein one end of the seventh radiating section is perpendicularly connected to the end of the sixth radiating section away from the fifth radiating section, another end of the seventh radiating section extends along a direction parallel to the first radiating section and away from the second radiating section.

15. The wireless communication device of claim 14, wherein the first antenna further comprises a second radiating portion, the second radiating portion is shorter than the first radiating portion, the second radiating portion comprises a first radiating arm and a second radiating arm, one end of the first radiating arm forms a curved connection with one side of the first ground point away from the first radiating section, another end of the first radiating arm extends away from the first radiating section; wherein one end of the second radiating arm forms a curved connection with the end of the first radiating arm away from the first ground point, another end of the second radiating arm extends towards the third radiating section.

16. The wireless communication device of claim 14, wherein the second antenna comprises a second feed point, a second ground point, a first extending portion, and a second extending portion; wherein the second feed point is positioned at one side of the first feed point away from the first ground point and is spaced apart from the first feed point, the second ground point is positioned between the first feed point and the second feed point; wherein the first extending portion is electrically connected to the second feed point and the second ground point to receive and send radiation signals in a third frequency band; wherein the second extending portion is electrically connected to the second feed point to receive and send radiation signals in the fourth frequency band.

17. The wireless communication device of claim 16, wherein one end of the first extending portion is perpendicularly connected to the second feed point and the second ground point, another end of the first extending portion extends along a direction parallel to the second radiating section and towards the third radiating section; wherein the second extending portion comprises a first extending section, a second extending section, a third extending section, and a fourth extending section, one end of the first extending section is perpendicularly connected to one side of the second feed point away from the second ground point, another end of the first extending section extends along a direction parallel to the first extending portion and away from the first radiating section and the second radiating section; wherein one end of the second extending section forms a curved connection with the end of the first extending section away from the second feed point, another end of the second extending section extends along a direction parallel to the first radiating section and towards the second radiating section; wherein one end of the third extending section is perpendicularly connected to the end of the second extending section away from the first extending section, another end of the third extending section extends along a direction parallel to the second radiating section and towards the third radiating section; wherein one end of the fourth extending section is perpendicularly connected to the end of the third extending section away from the second extending section, another end of the fourth extending section extends along a direction parallel to the second extending section and away from the third radiating section.

18. The wireless communication device of claim 14, wherein the third antenna comprises a third feed point, a third ground point, a first coupling portion, and a second coupling portion, the first coupling portion is electrically connected to the third feed point, the second coupling portion is electrically connected to the third ground point and the first coupling portion, the first coupling portion receives radiation signals in the fifth frequency band and the sixth frequency band.

19. The wireless communication device of claim 18, wherein the first coupling portion comprises a first coupling arm, a second coupling arm, a third coupling arm, a fourth coupling arm, a fifth coupling arm, and a sixth coupling arm, one end of the first coupling arm is electrically connected to the third feed point, the second coupling arm is perpendicularly connected to one end of the first coupling arm away from the third feed point; wherein one end of the third coupling arm is perpendicularly connected to one end of the second coupling arm away from the first coupling arm, another end of the third coupling arm extends along a direction parallel to the first coupling arm and away from the third ground point until the third coupling arm passes over the third feed point; wherein the fourth coupling arm forms a curved connection with the end of the third coupling arm away from the second coupling arm, the fifth coupling arm and the sixth coupling arm are both perpendicularly connected to one end of the fourth coupling arm away from the third coupling arm and extend towards two opposite direction, the fifth coupling arm, the sixth coupling arm, and the fourth coupling arm cooperatively form a T-shaped structure.

20. The wireless communication device of claim 19, wherein the second coupling portion comprises a first coupling section, a second coupling section, and a third coupling section, the first coupling section is electrically connected to the third ground point and extends away from the first coupling arm; wherein the second coupling section is perpendicularly connected to one end of the first coupling section away from the third ground point and extends along a direction parallel to the second coupling arm; wherein one end of the third coupling section is perpendicularly connected to one end of the second coupling section away from the first coupling section, another end of the third coupling section extends along a direction parallel to the first coupling section and towards the first coupling portion until the third coupling section is perpendicularly connected to a junction of the second coupling arm and the third coupling arm.

* * * * *